US007828195B2

(12) United States Patent
Edmondson

(10) Patent No.: US 7,828,195 B2
(45) Date of Patent: Nov. 9, 2010

(54) BOTTLE SLEEVES

(76) Inventor: Ben C. Edmondson, 1972 San Luis Dr., San Luis Obispo, CA (US) 93401

( * ) Notice: Subject to any disclaimer, the term of this patent is extended or adjusted under 35 U.S.C. 154(b) by 644 days.

(21) Appl. No.: 11/824,968

(22) Filed: Jul. 3, 2007

(65) Prior Publication Data

US 2009/0008436 A1 Jan. 8, 2009

(51) Int. Cl.

| | |
|---|---|
| ***B65D 65/00*** | (2006.01) |
| ***B65D 5/00*** | (2006.01) |
| ***B65D 3/26*** | (2006.01) |
| ***B65D 5/24*** | (2006.01) |

(52) U.S. Cl. ..... 229/89; 229/107; 229/201; 229/179; 229/170; 229/186

(58) Field of Classification Search ..... 229/89, 229/107, 201, 17, 179, 169, 170, 186, 215, 229/120.15; 206/551, 822, 426, 427, 446, 206/139

See application file for complete search history.

(56) References Cited

U.S. PATENT DOCUMENTS

| | | | | | |
|---|---|---|---|---|---|
| 382,120 | A | * | 5/1888 | Storey | 229/89 |
| 472,463 | A | * | 4/1892 | Mark | 229/89 |
| 1,413,108 | A | * | 4/1922 | Dyer | 206/277 |
| 1,897,143 | A | * | 2/1933 | Powell | 206/395 |
| 2,325,277 | A | * | 7/1943 | Rothe et al. | 221/63 |
| 2,331,085 | A | | 10/1943 | Sterling | |
| 2,333,328 | A | | 11/1943 | Merrill | |
| 2,342,600 | A | | 2/1944 | Potter | |
| 2,349,020 | A | | 5/1944 | Throckmorton | |
| 2,507,403 | A | * | 5/1950 | Gluck | 206/395 |
| 2,583,915 | A | * | 1/1952 | Whitley | 229/107 |
| 2,692,077 | A | * | 10/1954 | Kuhlman | 206/521 |
| 2,816,652 | A | * | 12/1957 | Clark | 206/525 |
| 2,884,181 | A | * | 4/1959 | McCormick | 206/527 |
| 3,680,726 | A | | 8/1972 | Massey | 215/12 R |
| 4,339,067 | A | * | 7/1982 | Bessey | 229/115 |
| 4,811,896 | A | | 3/1989 | Sohma | 229/89 |
| 5,125,564 | A | | 6/1992 | Capy | 229/87.03 |
| 5,299,734 | A | * | 4/1994 | Lane | 229/120.32 |
| 5,730,289 | A | | 3/1998 | Cappels | 206/434 |
| 5,806,683 | A | | 9/1998 | Gale | 206/587 |
| 6,206,224 | B1 | | 3/2001 | Potts et al. | 220/495.06 |
| 6,227,441 | B1 | * | 5/2001 | Sagel et al. | 229/117.35 |
| 6,718,733 | B2 | | 4/2004 | Kilmartin | 53/397 |

* cited by examiner

*Primary Examiner*—Jes F Pascua
(74) *Attorney, Agent, or Firm*—J. Curtis Edmondson

(57) ABSTRACT

The present invention provides bottle sleeves for bottles, such as beverage bottles. Bottle sleeves of the present invention include a rib. In one embodiment of the present invention, the bottle sleeves comprise a sleeve sidewall including a partially cylindrical sidewall section and a rib, wherein the sidewall is continuous with the rib. In another embodiment of the present invention the bottle sleeves comprise a substantially cylindrical sidewall and a rib such that the rib overlaps the sidewall. Ribs of the present invention include at least one rib stiffener that is positioned inside the rib interior.

19 Claims, 10 Drawing Sheets

BOTTLE SLEEVES

FIELD OF THE INVENTION

The present invention relates to bottle sleeves.

BACKGROUND OF THE INVENTION

Bottles made of rigid fragile materials, such as glass or some rigid plastic materials, are conventionally protected during shipping and storage in a variety of ways. Protection methods and techniques employ diverse materials and techniques to reduce contact between adjacent bottles. Such protection is particularly important when the subject bottle contains liquid, perishable or dangerous materials. For example, there is a well recognized need to protect bottles containing beverages, such as alcoholic and non-alcoholic beverages, during shipping and storage.

For efficiency of distribution and ease of use, glass beverage bottles are packaged in multiple bottle packages such as a packages conventionally referred to as a six-pack, i.e. a package containing 6 bottles, or alternatively a corrugated cardboard box containing for example 12 bottles. The bottles in a typical six-pack are separated from each other by thin cardboard partitions. A corrugated cardboard box usually employs corrugate cardboard partitions between the bottles. Cardboard boxes, when provided with a cardboard top cover and bottom, combined with a snugly fitting content of rigid bottles such as glass bottles, are convenient and relatively sturdy packaged units for shipping and storage.

Conventional bottle packaging techniques include bottle arrangements wherein bottles are packaged in an upright position, i.e. substantially perpendicular to the bottom of the packaged unit, and horizontally, i.e. substantially parallel to the bottom of the packaged unit. Alcoholic beverages, such as wines, are examples of beverages that are in some instances packaged in horizontally positioned bottles. It is generally known that organic cork materials that are typically used in closing wine bottles, dry out and shrink during storage if using bottles that are stored in an upright position. Cork shrinkage is known to result in air penetration in the bottle. Exposure to air typically results in lowering the quality of the wine. Horizontally shipped and/or packaged wine bottles tend to keep the cork moistened, thereby reducing or preventing cork shrinkage.

Once a product, such as bottled beverages, has been delivered to a retail store or for example a large volume user, such as a restaurant, bottles are removed from the shipping package. These bottles then lose the protection against breakage and unsightly surface damage that was provided by using a container such as a six-pack or a corrugated cardboard box.

When shelving individual bottles, for example wine bottles in a retail store, it is generally considered advantageous to store the wine bottles in a horizontal position particularly when the bottles are closed with an organic cork material, as described above.

Wine bottles typically have a cylindrical shape, they therefore tend to roll sideways when stored on a horizontal display surface such as a shelf. Wine racks are usually employed to keep wine bottles in a horizontal position and to prevent sideways rolling of horizontally stored cylindrically shaped bottles such as wine bottles.

The protection materials and techniques that are used during shipping and storage are usually not the most suitable materials and techniques for retail merchandising. In retail merchandising, bottled beverages such as wines bottled in glass bottles are typically inserted individually into a paper bag for the buyer's convenience and for protection of the bottle against breakage or unsightly chipping. Shipping and storage protection materials, such as cardboard boxes, are generally less suitable for retail merchandising, while six-pack containers are widely used.

Conventional bottle sleeves are disclosed for example in U.S. Pat. No. 6,718,733 (Kilmartin, 2004), U.S. Pat. No. 5,125,564 (Capy, 1992), U.S. Pat. No. 4,811,896 (Sohma, 1989), U.S. Pat. No. 3,680,726 (Massey, 1972), U.S. Pat. No. 2,342,600 (Potter, 1944), U.S. Pat. No. 2,333,328 (Merrill, 1943) and U.S. Pat. No. 2,331,085 (Sterling, 1943). However, these conventional bottle sleeves are believed to lack suitable features or means for preventing sideways rolling of cylindrical bottles when stored on a horizontal surface.

Accordingly, a need exists for a multi-purpose bottle sleeve that provides protection of bottles during shipping and retail distribution, and that provides a means for reducing or substantially preventing sideways rolling of cylindrically shaped bottles.

SUMMARY OF THE INVENTION

The present invention provides bottle sleeves for bottles made of rigid, fragile materials containing beverages such as wine.

In one embodiment of the present invention, the bottle sleeves comprise a sleeve sidewall that includes a sidewall section and a rib. The sidewall section includes a radius, an angle, a partial circumference and an axis. Bottle sleeves of the subject embodiment further include a rib which is positioned substantially parallel to the axis of the sidewall section. The rib includes first and second rib members that are substantially parallel to the sidewall radius, a rib inside angle between the first and second rib members, a substantially wedge shaped crossection, a rib edge that is provided at the position where the first and second rib members are joined, and at least one rib stiffener. The at least one rib stiffener is positioned inside the rib, is attached to the first and second rib members and is substantially perpendicular to the rib edge. The sidewall section is continuous with the first and second rib members.

In another embodiment of the present invention, the bottle sleeves comprise a substantially cylindrical sidewall having an axis. The subject embodiment further includes a rib that overlaps the sidewall. The rib comprises first and second rib members that are joined at a rib edge, wherein the first and second rib members and the rib edge are substantially parallel to the axis. The rib further includes a rib stiffener positioned inside the rib and attached to the first and second rib members. The rib stiffener is substantially perpendicular to the rib edge.

Suitable materials for bottle sleeves of the present invention include paper product pliable sheets.

DETAILED DESCRIPTION OF THE INVENTION

While describing the invention and its embodiments, certain terminology will be utilized for the sake of clarity. It is intended that such terminology include the recited embodiments as well as all equivalents.

Figure 2:
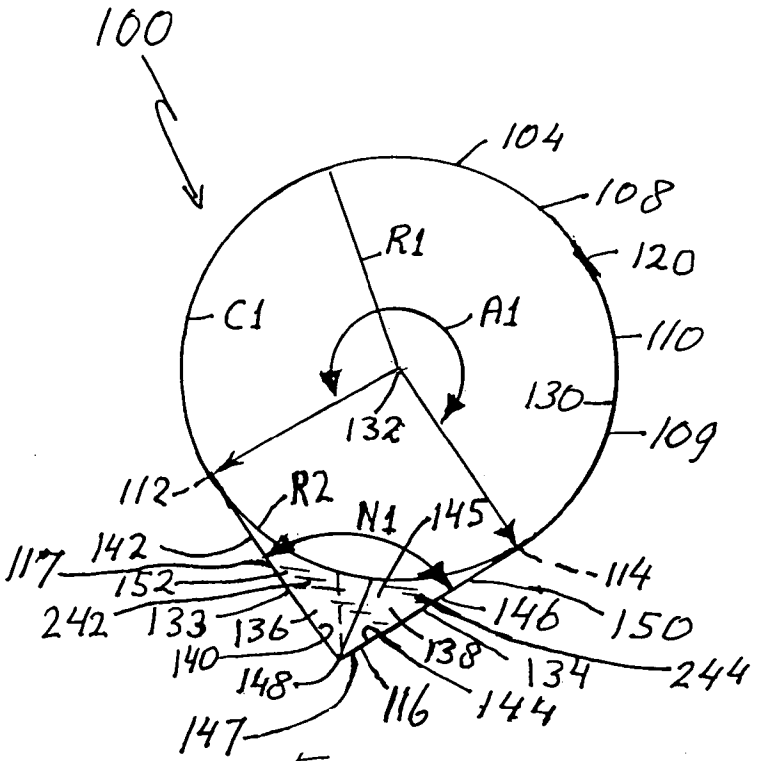
FIG. 2 is a schematic cross sectional view of FIG. 1 along the lines X1-X1.
Figure 1:
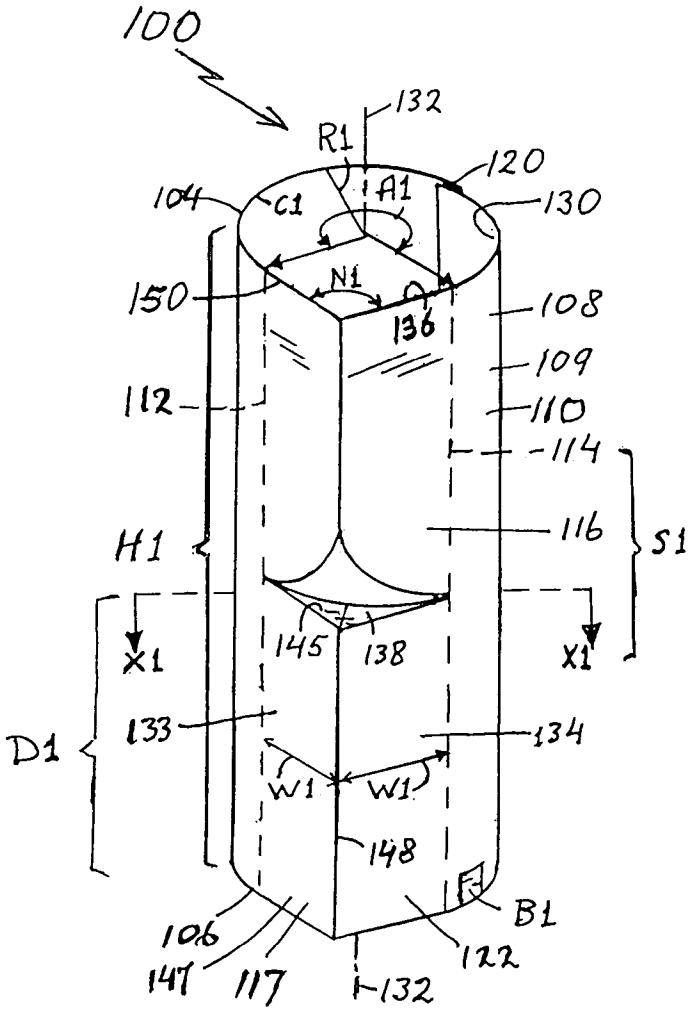
FIG. 1 is a schematic perspective view illustrating a bottle sleeve of the present invention.

One embodiment of the invention is schematically illustrated in FIGS. 1-12. FIGS. 1 and 2 show a tube shaped bottle sleeve 100 comprising (1) a top edge 104, (2) a bottom edge 106 opposing top edge 104, (3) a sleeve sidewall 108 extending between top and bottom edges 104 and 106 respectively and (4) a sleeve height H1 between top and bottom edges 104 and 106 respectively. It is noted that FIG. 2 is a schematic cross sectional view of bottle sleeve 100 depicted in FIG. 1, along the lines X1-X1. Sleeve sidewall 108 (FIGS. 1 and 2) additionally includes (1) a sleeve sidewall outside surface 109, (2) a sidewall section 110 extending (i) between top and bottom edges 104 and 106 respectively, and (ii) between marks 112 and 114 of sleeve 100 such that marks 112 and 114 are substantially parallel to each other and (2) a rib 116 including an outside surface 117 (FIGS. 1 and 2) and (3) a sidewall joint 120 that is (i) substantially perpendicular to top and bottom edges 104 and 106 respectively and (ii) substantially parallel to marks 112 and 114. It is noted that sleeve sidewall 108 is formed by sidewall section 110 and rib 116. Sleeve sidewall 108 is adapted for retaining a cylindrically shaped bottle therein. Sidewall section 110 includes a partly cylindrical shape, such that sidewall section 110 is continuous with rib 116 at marks 112 and 114, as illustrated and described in connection with FIG. 4.

The terms "mark" and "marks" as used herein and as shown as a broken line in the relevant drawings, mean a line indicating a position in the drawing wherein the broken line itself is not a structural component of the relevant object shown in the drawing. The terms "substantial" and "substantially" as used herein mean at least 90% of the relevant 100%.

With reference to FIGS. 1 and 2, sleeve sidewall section 110 further comprises an inside surface 130, including (1) a radius R1, (2) an angle A1, (3) a cylindrical surface with a partial circumference C1 and (4) an axis 132 positioned axially with respect to inside surface 130. It is noted that marks 112 and 114 define the limits of sidewall section 110, when measured substantially perpendicular to axis 132, because marks 112 and 114 are defined by angle A1.

Figure 3:
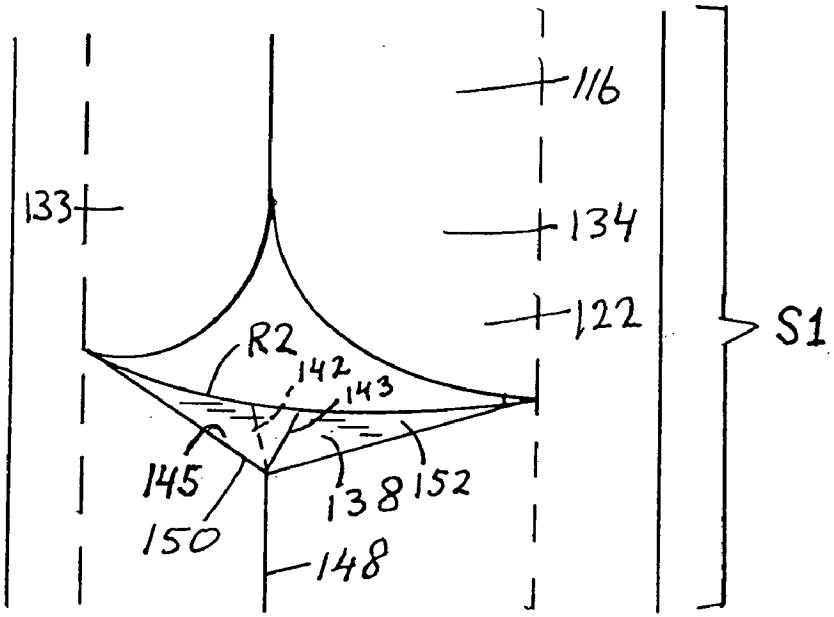
FIG. 3 is a schematic enlarged view of section S1 of FIG. 1.
Figure 6:
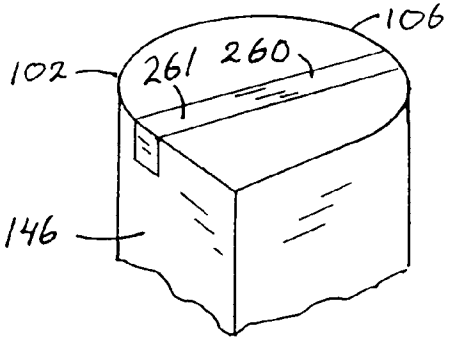
FIG. 6 is a perspective bottom view of a bottom component of the bottle sleeve illustrated in FIG. 1.

As depicted in FIGS. 1, 2 and 3, rib 116 of bottle sleeve 100 includes (1) a first rib member 133, (2) a second rib member 134, wherein rib members 133 and 134 are positioned substantially parallel to each other and to axis 132, (3) a rib interior 136, (4) a rib inside angle N1 and (5) a rib stiffener 138. As shown in FIG. 2, rib 116 further includes (1) an inside surface 140 of first rib member 133, (2) an outside surface 142 of first rib member 133, (3) an inside surface 144 of second rib member 134, and (4) outside surface 146 of second rib member 134. Rib members 133 and 134 include substantially the same width W1 (FIG. 1). Rib 116 additionally includes a rib outside surface 147 comprising outside surface 142 and 144 of rib members 133 and 134. FIG. 3 illustrates an enlargement of section S1 of bottle sleeve 100 depicted in FIGS. 1 and 2. The expression "rib stiffener" as used herein means a structural element that is employed to support (1) the rib, (2) the rib members and (3) the rib inside angle.

Rib 116 (FIGS. 1-3) additionally includes a rib edge 148, formed by a joint between first rib member 133 and second rib member 134 respectively. It is further noted that rib 116 includes a substantially wedge shaped cross section 150, wherein the wedge shape is formed between rib members 133 and 134. Rib edge 148 is substantially (1) parallel to axis 132 of sleeve sidewall section 110 and (2) perpendicular to (i) top edge 104 and (ii) bottom edge 106 of bottle sleeve 100.

With reference to FIGS. 1 and 3, rib stiffener 138 of rib 116 comprises (1) a stiffener surface 145 that is positioned substantially perpendicular to (i) rib edge 148, (ii) axis 132 and (iii) first and second rib members 133 and 134 respectively, (2) a stiffener radius R2 that is substantially equal to radius R1, and wherein rib stiffener 138 is attached to first rib member 133 and to second rib member 134. As depicted in FIG. 1, distance D1 denotes the distance between rib stiffener 138 and bottom edge 106. It is noted that stiffener surface 145 (FIG. 1) is positioned in the cross sectional view of bottle sleeve 100 depicted in FIG. 2. It is further noted that rib stiffener 138 is positioned substantially perpendicular to (1) rib edge 148 and (ii) axis 132.

Bottle sleeve 100 additionally includes one or more bottom components such as schematically shown bottom component B1 (FIG. 1), as is more fully illustrated and described in connection with FIGS. 6-11.

Figure 4:
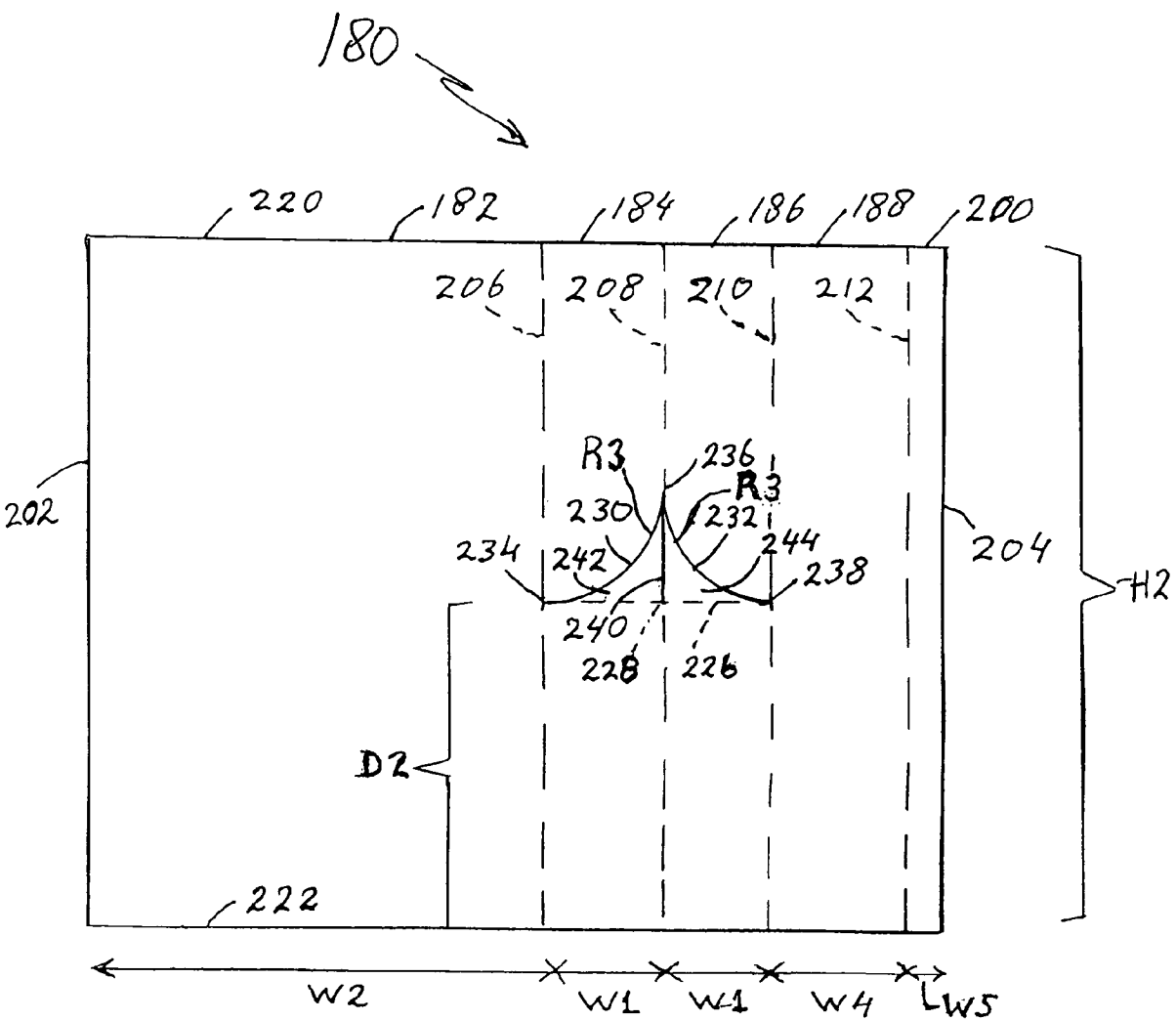
FIG. 4 is a schematic plan view illustrating a sheet of pliable material of the present invention for fabricating the bottle sleeve illustrated in FIG. 1.

Sidewall 108 including sidewall section 110 and rib 116 can for example be fabricated using a substantially rectangular sheet 180 of a pliable sheet material, see FIG. 4. Sheet 180 includes substantially rectangular sheet sections 182, 184, 186, 188 and 200. Sheet 180 additionally includes a first edge 202 and a second edge 204, wherein edges 202 and 204 are substantially parallel to a height H2 of sheet 180 and such that height H2 is substantially equal to sleeve height H1, depicted in FIG. 1.

The expression "pliable sheet material" as used herein means a sheet that can be bent and folded.

As depicted in FIG. 4, sheet 180 includes first edge 202 that is positioned as an edge of section 182, while second edge 204 of sheet 180 is positioned as an edge of section 200. It is further noted that (1) a mark 206 separates section 182 from section 184, (2) a mark 208 separates section 184 from section 186, (3) a mark 210 separates section 186 from section 188 and (4) a mark 212 separates section 188 from section 200. Edges 202 and 204, and marks 206, 208, 210 and 212 are substantially parallel. Section 182 includes a width W2 (FIG. 3). Sections 184 and 186 each include width W1. Section 188 includes a width W4, while section 200 includes a width W5. Sheet 180 additionally includes a top edge 220 and a bottom edge 222 such that top and bottom edges 220 and 222 are substantially perpendicular to edges 202 and 204. Sheet sections 182 and 188 (FIG. 4) are adapted for forming sleeve sidewall section 110 (FIGS. 1, 2 and 3), while sheet sections 184 and 186 are adapted for forming first and second rib members 133 and 134 respectively (FIGS. 1, 2 and 3). Sheet section 182 (FIG. 4) is continuous with sheet section 184, while sheet section 188 is continuous with sheet section 186. Consequently, sleeve sidewall section 110 (FIGS. 1, 2 and 3) is continuous with first and second rib members 133 and 134 respectively.

The term "continuous" as used herein means a seamless connection between the subject components, wherein the connection is uniform in thickness with the subject components.

As illustrated in FIG. 4, a substantially straight line mark 226 is made perpendicularly across sections 184 and 186 of sheet 180 at a position 228 on mark 208. Radial cuts 230 and 232 are cut through sheet 180 in sections 184 and 186 respectively. Radial cut 230 is substantially tangential to mark 226 at a point 234, where mark 226 crosses mark 206. Additionally, radial cut 230 is substantially tangential to mark 208 at a point 236 on mark 208. Similarly, radial cut 232 is substantially tangential to mark 226 at a point 238, where mark 226 crosses mark 210. Additionally, radial cut 232 is substantially tangential to mark 208 at point 236 on mark 208. Radial cuts 230 and 232 each have a radius R3 that is substantially equal to R1. Distance D2 between point 228 and edge 222 of sheet 180 is substantially equal to D1 of sleeve 100 shown in FIG. 1. Subsequently, a cut 240 is made through sheet 180 between points 228 and 236, resulting in forming stiffening members 242 and 244, see FIG. 4.

Figure 5:
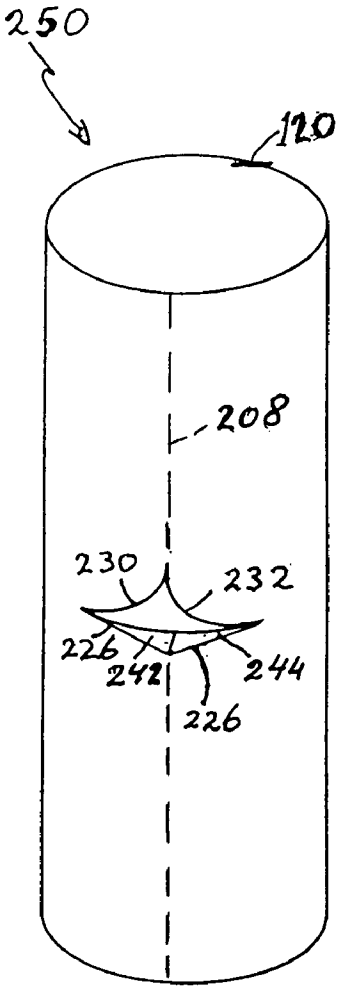
FIG. 5 is a schematic perspective view illustrating an intermediate product of the present invention, for the bottle sleeve illustrated in FIG. 1.

With reference to FIGS. 4 and 5, a suitable process for fabricating bottle sleeve 100 can then be continued by employing for example the following steps: (1) position section 200 on or under section 182, using techniques that are known to a person of ordinary skill in the art, (2) fasten section 200 to section 182 to make joint 120, using techniques that are known to a person of ordinary skill in the art, using for example gluing, thereby forming a tube 250, see FIG. 5. It is noted that tube 250 comprises an intermediate product for fabricating bottle sleeve 100 (FIG. 1). Then, in step 3 (FIGS. 4 and 5), bending or folding stiffener members 242 and 244 along mark 226 into tube 250 such that the stiffener members are substantially perpendicular to mark 208 see FIGS. 4 and 5. In step 4, the desired rib inside angle N2 (FIG. 2) is formed by bending or folding sheet sections 184 and 186 of sheet 180 along mark 208 (FIG. 4) thereby forming rib 116 as well as rib members 133 and 134 (FIGS. 1 and 3) and the desired rib angle N1. Sleeve sidewall section 110 (FIGS. 1 and 2) can for example be fabricated, using techniques that are known to a person of ordinary skill in the art, using for example a mandrel (not shown), (5) after which stiffener members 242 and 244 can be fastened to each other, for example by gluing stiffener member 242 to stiffener member 244 (FIG. 3), resulting in rib stiffener 138 having a radius R2, as illustrated in FIGS. 2 and 3. It is noted that mark 208 shown in FIG. 5 corresponds to mark 208 depicted in FIG. 4 and rib edge 148 depicted in FIGS. 1-3, it is further noted that tube 250 (FIG. 5) is an intermediate product for fabricating bottle sleeve 100 (FIGS. 1-3).

It is noted that sidewall section 110 (FIG. 1) and rib 116 of bottle sleeve 100 are included in a single sheet of pliable material that is based on sheet 180 depicted in FIG. 4.

Figure 7:
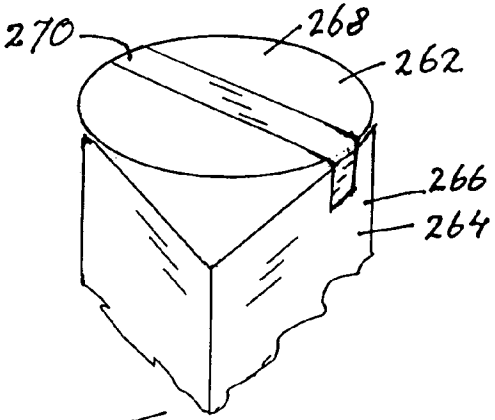
FIG. 7 is a perspective bottom view of another bottom component of the bottle sleeve illustrated in FIG. 1.

Bottle sleeve 100 additionally comprises a bottom component 260, as illustrated in 6 and schematically depicted as bottom component B1 of bottle sleeve 100 (FIG. 1). Returning to FIG. 6, bottom component 260 includes a conventional strap 261 (FIG. 6), that crosses over bottom edge 106 of bottle sleeve 100 and that is attached, for example glued, to outside surface 109 of sidewall 108 of bottle sleeve 100. FIG. 7 illustrates an alternative bottom component 262 that is attached to an outside surface 264 of a bottle sleeve 266 similar to outside surface 109 of sleeve 100 (FIG. 1). Returning to FIG. 7, bottom component 262 comprises a disc 268 and a strap 270, wherein strap 270 attaches disc 268 to outside surface 264 of bottle sleeve 266.

Figure 9:
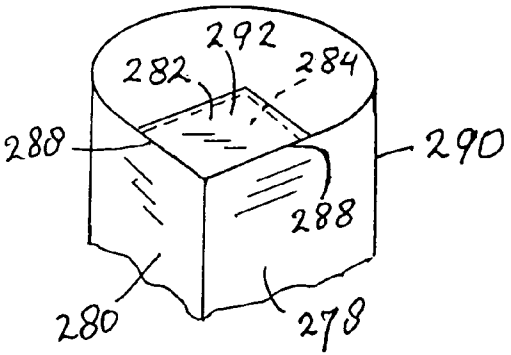
FIG. 9 is a perspective bottom view of a bottom component of the present invention, using the sheet of pliable material illustrated in FIG. 8.
Figure 11:
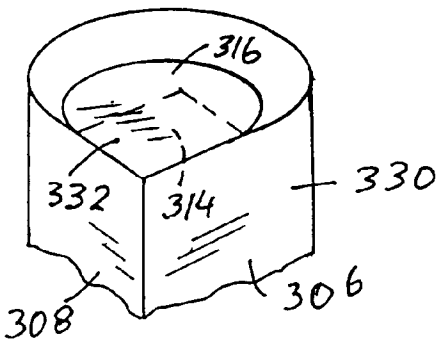
FIG. 11 is a perspective bottom view of a bottom component of the present invention, using the sheet of pliable material illustrated in FIG. 10.
Figure 8:
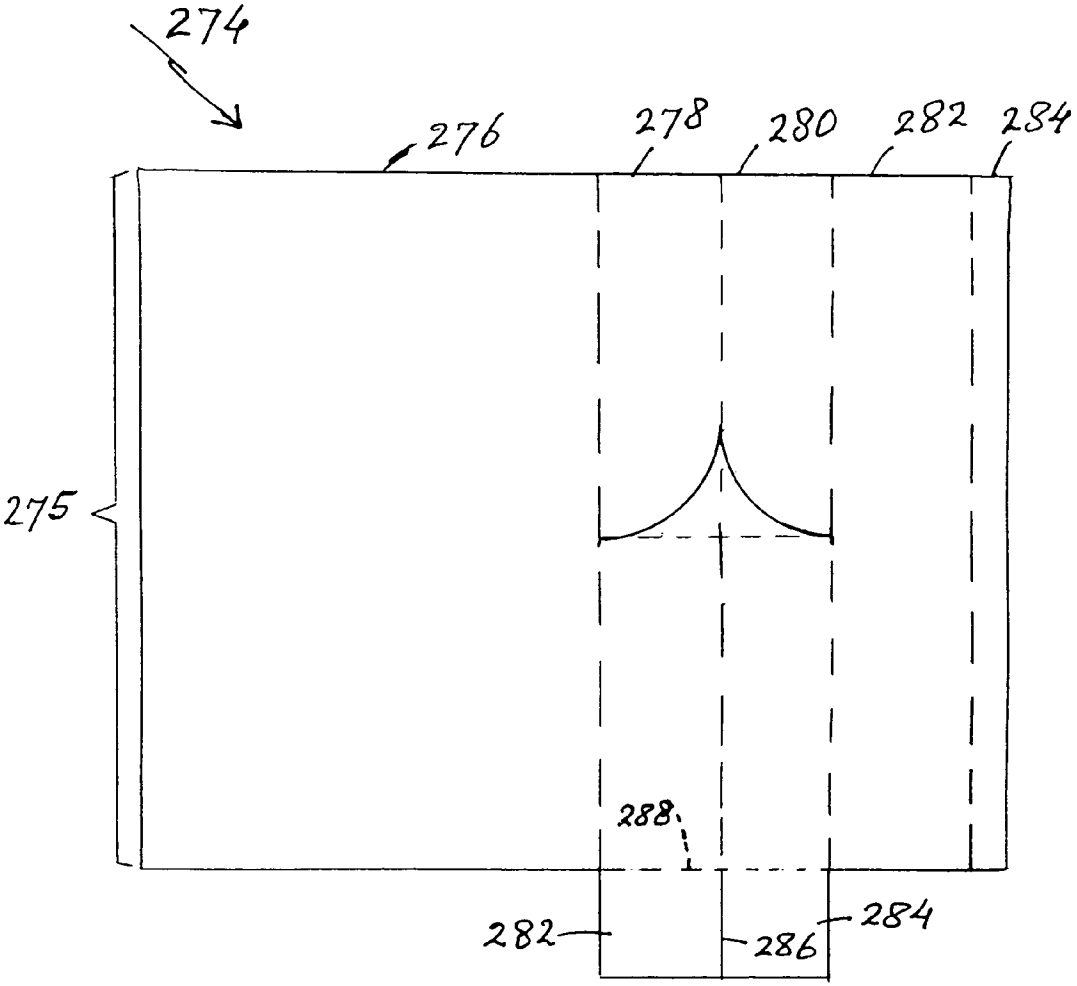
FIG. 8 is a schematic plan view illustrating a sheet of pliable material of the present invention, for fabricating a bottle sleeve of the present invention including a bottom component.
Figure 10:
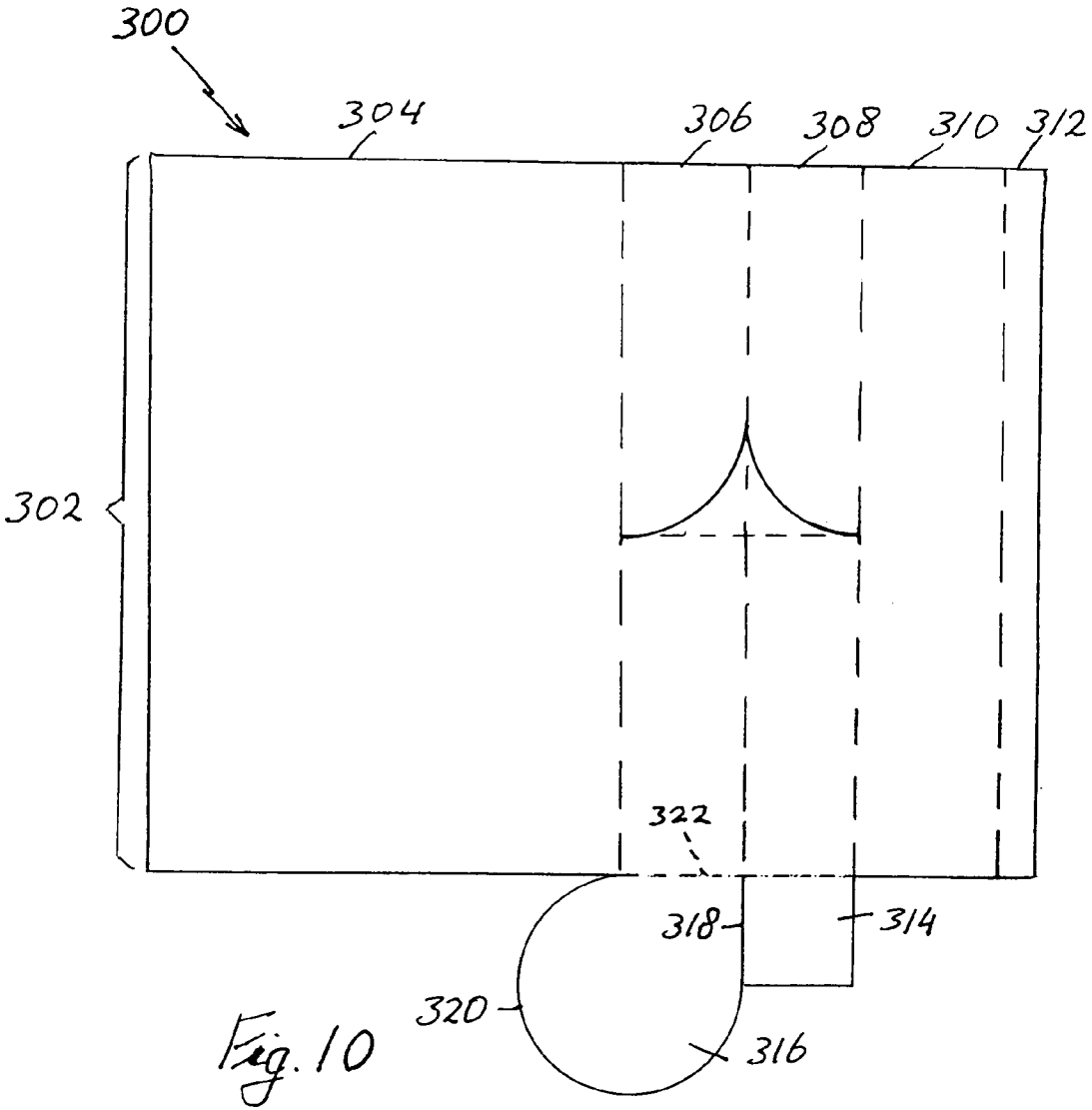
FIG. 10 is a schematic plan view illustrating a sheet of pliable material of the present invention, for fabricating a bottle sleeve of the present invention including a bottom component.

Additional examples of suitable bottom components comprise bottom components that include one or more sections of the sheet of pliable material from which bottle sleeves of the present invention can be fabricated, as illustrated and described in connection with FIGS. 8-11. FIG. 8 depicts a sheet 274 including sections 275, 276, 278, 280, 282 and 284. Section 275 includes sections 276, 278, 280, 282 and 284 such that section 275 is similar to sheet 180 shown in FIG. 4. Returning to FIG. 8, sections 282 and 284 extend from sections 278 and 280 respectively. A cut 286 separates section 282 from section 284. Using techniques similar to those described in connection with fabricating bottle sleeve 100 (FIGS. 1-5), a bottle sleeve 290 is fabricated as shown in FIG. 9. Bottle sleeve 290 includes a bottom component 292 comprising sheet sections 282 and 284 that are folded along mark 288 and then attached to each other as illustrated in FIG. 9, for example by gluing sheet section 282 to sheet section 284. Another example of a suitable bottom component for bottle sleeves of the present invention is schematically illustrated in FIGS. 10 and 11. FIG. 10 depicts a pliable sheet 300 including sections 302, 304, 306, 308 310, 312, 314 and 316, wherein sections 302, 304, 306, 308, 310, 312 and 314 are similar to sections 275, 276, 278, 280, 282 and 284 of sheet 274 (FIG. 8) respectively. A cut 318 separates section 314 from section 316. Section 316 is larger than section 314. Additionally, edge 320 of section 316 is partly circular. Mark 322 of sheet 300 (FIG. 10) is similar to mark 288 of sheet 274 shown in FIG. 8. Using techniques similar to those described in connection with bottom component 290 (FIGS. 8 and 9), a bottle sleeve 330 similar to bottle sleeve 100 (FIGS. 1-3 and 5) including a bottom component 332, are fabricated as shown in FIG. 11. Bottom component 332 provides a surface for product identification or for advertising when bottle sleeve 330 is used to display a bottle in a horizontal position. It is noted that bottom component 332 comprises sections 314 and 316 of sheet 300 (FIG. 10). It is further noted that for example strap 261 of bottom component (FIG. 6) and disc 268 of bottom component (FIG. 7) are suitable for product identification and advertising.

Figure 12:
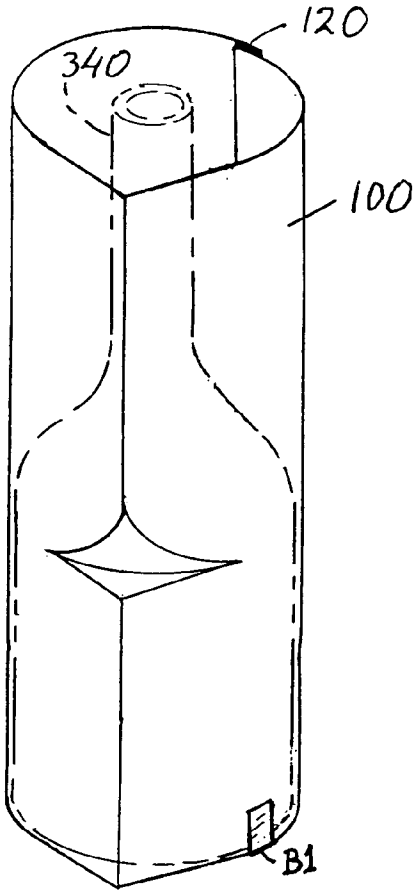
FIG. 12 is a schematic perspective view illustrating the bottle sleeve depicted in FIG. 1, wherein the bottle sleeve contains a cylindrically shaped bottle.
Figure 13:
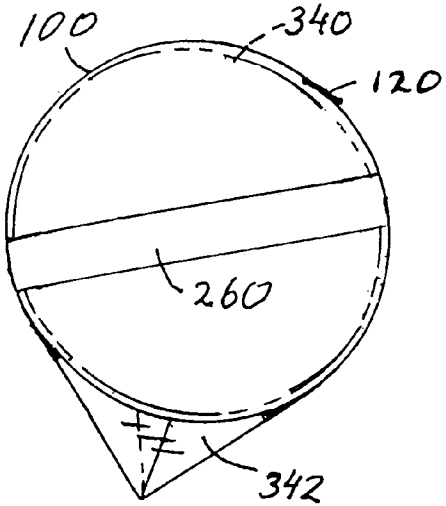
FIG. 13 is a schematic bottom plan view of the bottle sleeve of the present invention containing a bottle, that is depicted in FIG. 12.

FIGS. 12 and 13 illustrate bottle sleeve 100 containing a cylindrically shaped bottle 340 therein. Bottle 340 is shown in phantom lines to clearly indicate that bottle 340 is not a component of bottle sleeve 100. FIG. 13 shows a bottom view of bottle sleeve 100 and bottle 340 illustrated in FIG. 12. Additionally, FIG. 13 depicts a rib stiffener 342 similar to rib stiffener 138 of bottle sleeve 100 depicted in FIG. 2.

Figure 14:
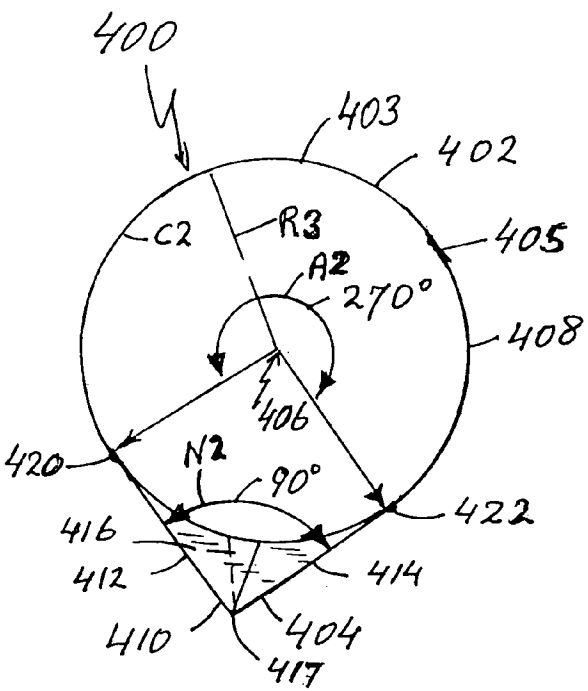
FIG. 14 is a schematic cross sectional view of another bottle sleeve of the present invention.

With reference to FIG. 14, a bottle sleeve 400, similar to bottle sleeve 100 (FIGS. 1-3 and 5) comprises (1) a sleeve sidewall 402 (FIG. 14) that includes (1) a sidewall section 403 and (2) a rib 404 and (3) sleeve joint 405. Sidewall section 403 includes (1) an inside radius R3 (2) an arc A2 substantially equal to 270°, (3) an inside circumference C2 that is substantially equal in length to 4.71 multiplied by radius R2 (FIG. 2), (4) an axis 406 (FIG. 14), (5) and an outside surface 408. Rib 404 includes (1) first and second rib members 412 and 414 respectively, (2) a rib inside angle N2 substantially equal to 90° (3) a rib stiffener 416 that is substantially perpendicular to axis 406 and (4) a rib edge 417. Sleeve sidewall section 403 and rib 404 each extend between marks 420 and 422 (FIG. 14), wherein marks 420 and 422 correspond to marks 140 and 142 respectively of bottle sleeve 100 (FIG. 1). Returning to FIG. 14, sleeve sidewall section 403 is continuous with rib 404 at marks 420 and 422. First rib member 412 is substantially tangential to sidewall section 403 at mark 420, while second rib member 414 is substantially tangential to sidewall section 403 at mark 422 due to: (i) an inside arc A2 of sidewall section 403 that is substantially equal to 270° (ii) a rib inside angle N2 that is substantially equal to 90° and (iii) a sleeve inside circumference C2 substantially equal in length to 4.71 multiplied by radius R3. Bottle sleeve 400 includes a bottom component such as bottom components 260 (FIG. 6), 262 (FIG. 7), 292 (FIG. 9) and 232 (FIG. 11).

Figure 15:
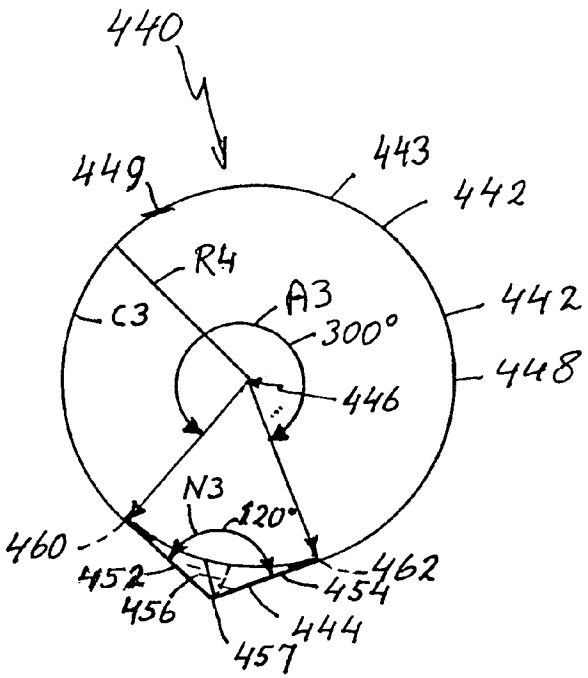
FIG. 15 is a schematic cross sectional view of still another bottle sleeve of the present invention.

With reference to FIG. 15, a bottle sleeve 440, similar to bottle sleeve 100 (FIGS. 1-3 and 5) comprises (1) a sleeve sidewall 442 (FIG. 15) and (2) a rib 444. Sidewall 442 includes a sidewall section 443 comprising (1) an inside radius R4, (2) an arc A3 substantially equal to 300°, (3) an inside partial circumference C3 that is substantially equal in length to 5.23 multiplied by R3 (FIG. 2), (4) an axis 446 (FIG. 15) (5) an outside surface 448 and (6) a sleeve joint 449. Rib 444 includes (1) first and second rib members 452 and 454 respectively, (2) a rib inside angle N3 substantially equal to 120°, (3) a rib stiffener 456 that is substantially perpendicular to axis 446 and (4) a rib edge 457. Sleeve sidewall section 443 and rib 444 each extend between marks 460 and 462 (FIG. 15), wherein marks 460 and 462 correspond to marks 140 and 142 respectively of bottle sleeve 100 (FIG. 1). Returning to FIG. 15, first rib member 452 is substantially tangential to sidewall section 443 at mark 460, while second rib member 444 is substantially tangential to sidewall section 443 at mark 462 due to (i) an angle A3 substantially equal to 300° of sidewall 443 (ii) a rib inside angle N3 substantially equal to 120° and (iii) a sidewall section 443, inside circumference C3 substantially equal in length to 5.23 multiplied by radius R3. Bottle sleeve 440 includes a bottom component such as bottom components 260 (FIG. 6), 262 (FIG. 7), 292 (FIG. 9) and 232 (FIG. 11).

It is noted that the position of sleeve joints 120 (FIGS. 1, 2 and 5), 405 (FIG. 14) and 449 (FIG. 15) is not critical.

Figure 17:
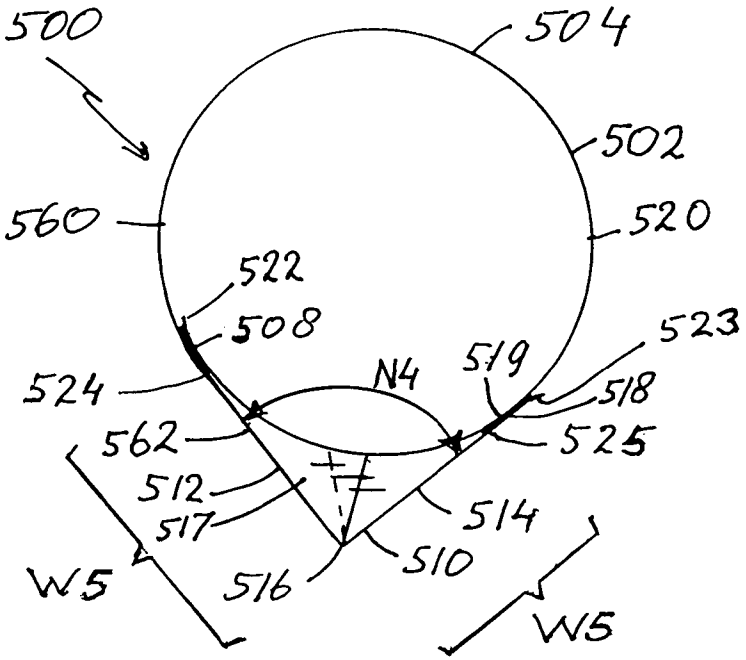
FIG. 17 is a schematic cross sectional view of FIG. 16 along the lines X2-X2.
Figure 16:
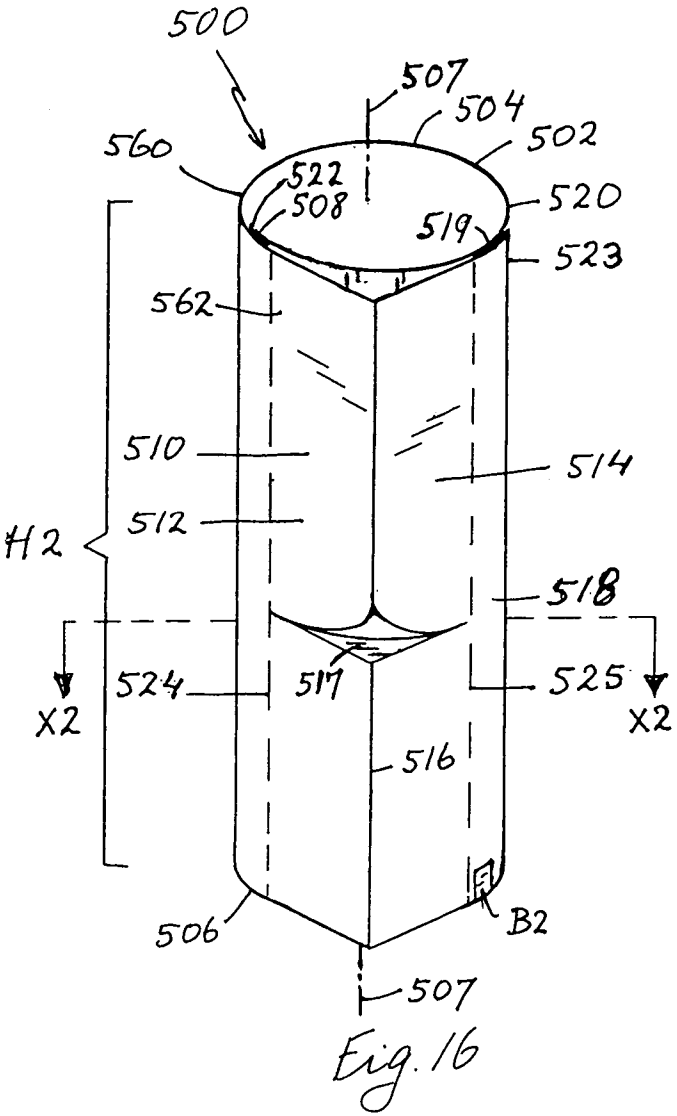
FIG. 16 is a schematic perspective view illustrating another bottle sleeve of the present invention.

Another embodiment of the present invention is schematically illustrated in FIGS. 16-20. FIGS. 16 and 17 depict a bottle sleeve 500 comprising (1) a substantially cylindrical sidewall 502 including (i) a top edge 504, (ii) a bottom edge 506 and (iii) an axis 507, (2) a first sidewall joint 508, (3) a rib 510 including (i) a first rib member 512, (ii) a second rib member 514, (iii) a rib inside angle N4 that is formed between rib members 512 and 514, (iv) a rib edge 516 formed where first rib member 512 is joined to second rib member 514, wherein rib edge 516 is substantially perpendicular to top edge 504 and to bottom edge 506 of sleeve 500 and wherein rib edge 516 is substantially parallel to axis 507 of sidewall 502 (FIG. 16) and (v) a rib stiffener 517 substantially perpendicular to rib edge 516, (4) a joint forming section 518 extending from second rib member 514, (5) a second sidewall joint 519 that is formed between sidewall 502 and joint forming section 518 and (6) a height H2, measured between top and bottom edges 504 and 506 respectively. It is noted that FIG. 17 is a schematic cross sectional view of bottle sleeve 500 depicted in FIG. 16, along the lines X2-X2. The position of the lines X2-X2 of FIG. 16 is similar to the position of lines X1-X1 in FIG. 1, i.e. this position includes rib stiffener 517 shown in FIG. 16. Sidewall 502, rib 510 and joint forming section 518 comprise a single sheet of pliable material such as sheet 520 illustrated and described in connection with FIG. 18. It is noted first sidewall joint 508 (FIGS. 16 and 17) is a joint that is formed in sidewall 502, while second sidewall joint 519 is formed by sidewall 502 and rib member 514 of rib 510. The expression "joint forming section" as used herein means a section of the sheet, from which a bottle sleeve of the present invention is fabricated, that is employed to form a joint with another section of the sheet.

With reference to FIGS. 16 and 17, sheet 520 includes (1) a first side edge 522 along sidewall joint 508 and (2) a second side edge 523 along joint forming section 518, wherein edges 522 and 523 are substantially parallel to rib edge 516. Sidewall 502 is continuous with first rib member 512. First rib member 512 additionally is continuous with second rib member 514. Second rib member 514 additionally is continuous with joint forming section 518. Rib 510 overlaps sidewall 502 between marks 524 and 525.

Figure 18:
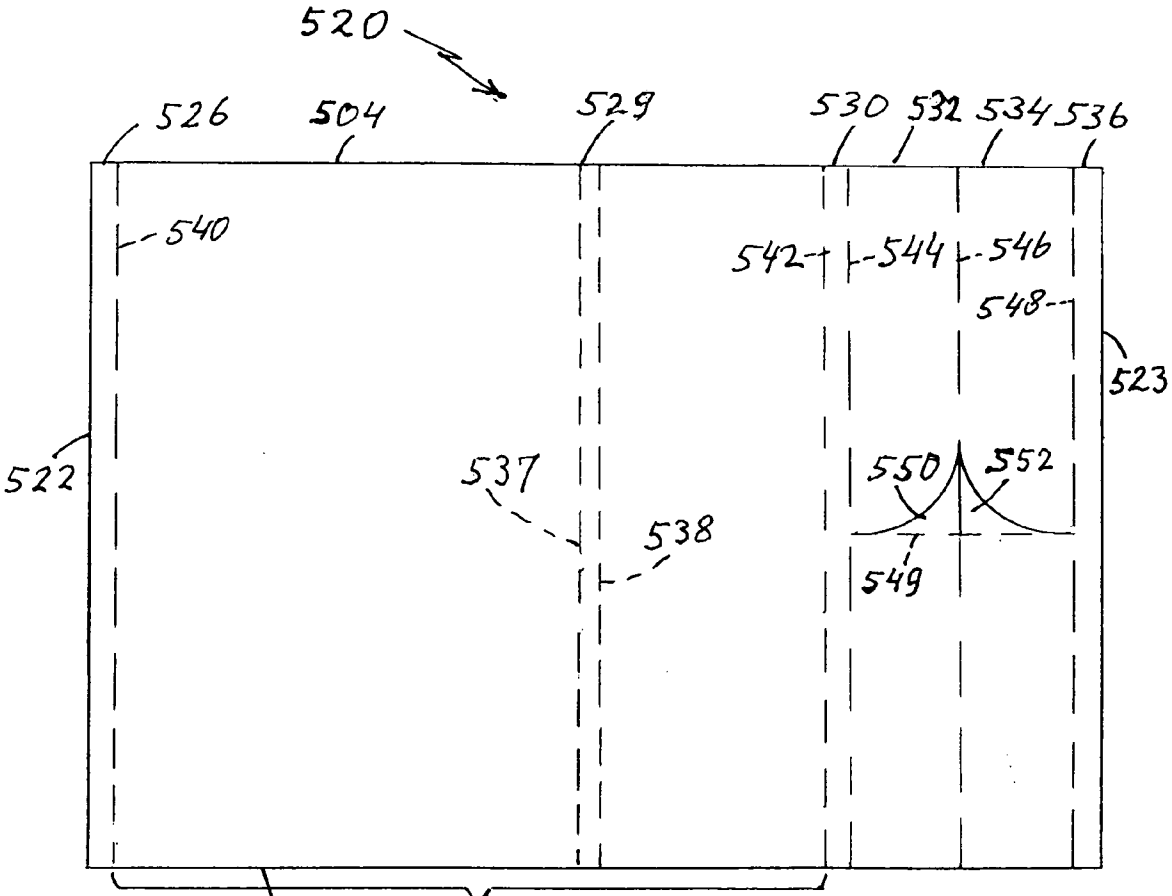
FIG. 18 is a schematic plan view illustrating a sheet of pliable material of the present invention for fabricating the bottle sleeve illustrated in FIG. 16.

As depicted in FIG. 18, sheet 520 includes side edges 522 and 523 and, substantially rectangular sheet sections 526, 528, 529, 530, 532, 534 and 536, wherein section 529 is included in section 528. A mark 540 separates section 526 from section 528. A mark 542 separates section 528 from section 530. A mark 544 separates section 530 from section 532. A mark 546 separates section 532 from 534, while a mark 548 separates section 534 from section 536. Mark 549 (FIG. 18) is similar to mark 226 shown in FIG. 4. Returning to FIG. 18, section 526 extends between side edge 522 and mark 540, while section 536 extends between side edge 523 and mark 548. Sheet 520 additionally includes top edge 504 and bottom edge 506. The position of section 529 on sheet 520 is indicated by marks 537 and 538, see FIG. 18. It is noted that sections 532 and 534 and mark 546 of sheet 520 correspond to first and second rib members 512 and 514 and rib edge 516 respectively of bottle sleeve 500 shown in FIG. 16. By analogy with FIG. 4, stiffener members 550 and 552 are fabricated in sheet 520 (FIG. 18), similar to stiffener members 242 and 244 illustrated in FIG. 4. Subsequently, employing techniques similar to those illustrated and described in connection with FIG. 4, sections 526, 528 and 530 (FIG. 19) of sheet 520 are curved whereafter section 526 is attached to section 530, for example by gluing, thus forming joint 508.

Figure 19:
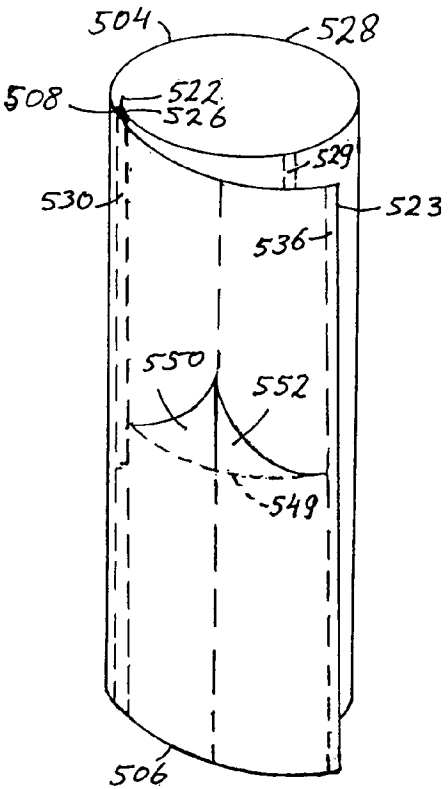
FIG. 19 is a schematic perspective view illustrating an intermediate product for the bottle sleeve of the present invention illustrated in FIG. 16.

Structure 560, illustrated in FIG. 19 is an intermediate product for fabricating bottle sleeve 500, shown in FIG. 16. Then, sections 532 and 534 are folded or bent to form rib inside angle N4, see FIG. 17. A rib stiffener 517 is fabricated in rib 510, whereafter section 536 is attached to section 529, thereby completing fabricating bottle sleeve 500 depicted in FIG. 16. It is noted that the placement of section 529 in sheet section 528 (FIGS. 18 and 19) is determined by width W5 of rib sections 512 and 514 (FIG. 17) and by rib inside angle N4.

As illustrated in FIGS. 16 and 17, sleeve sidewall 502 is continuous with rib member 512, but not with rib member 514 because rib 512 overlaps sleeve sidewall 502. Sleeve 500 further comprises an outside surface 560 that includes an outside surface 562 of rib 512. Bottle sleeve 500 further includes one or more bottom components B2 (FIG. 16) such as bottom components 260 (FIG. 6), 262 (FIG. 7), 292 (FIG. 9) and 332 (FIG. 11).

It is noted that sidewall 502 (FIG. 16) and rib 510 of bottle sleeve 500 are included in a single sheet of pliable material that is based on sheet 520 illustrated in FIG. 18.

Figure 20:
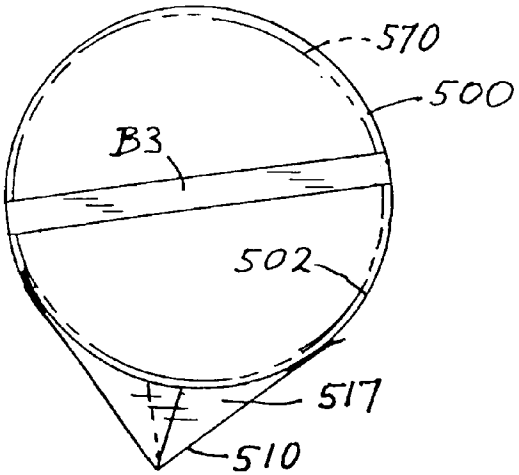
FIG. 20 is a schematic bottom view illustrating the bottle sleeve of the present invention shown in FIG. 16, containing a bottle.

FIG. 20 illustrates bottle sleeve 500 containing a substantially cylindrically shaped bottle 570 therein. It is noted that bottle 570 is retained within sidewall 502 of bottle sleeve 500.

Figure 21:
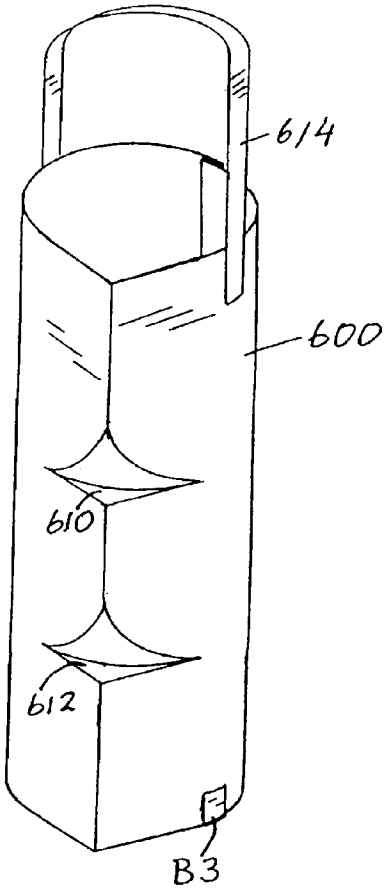
FIG. 21 is a schematic perspective view illustrating yet another bottle sleeve of the present invention.

Bottle sleeves 100 (FIGS. 1-3), 400 (FIG. 14), 440 (FIG. 15) and 500 (FIG. 16) each include one rib stiffener, i.e. rib stiffeners 138, 416, 456 and 517 respectively. However, it is also contemplated to provide bottle sleeves including more than one rib stiffener in one rib, as illustrated in bottle sleeve 600, schematically depicted in FIG. 21. Bottle sleeve 600 is similar to bottle sleeve 100 (FIGS. 1-3) except that bottle sleeve 600 (FIG. 21) includes two rib stiffeners 610 and 612, while bottle sleeve 100 (FIGS. 1-3) includes one rib stiffener, i.e. rib stiffener 138. Each of rib stiffeners 610 and 612 of bottle sleeve 600 (FIG. 21) is similar to rib stiffener 138 of bottle sleeve 100 (FIGS. 1-3). Returning to FIG. 21 bottle sleeve 600 additionally includes a carrying strap 614 comprising a conventional carrying strap that is typically used in paper bags. As shown in FIG. 21, bottle sleeve 600 includes a bottom component B3, similar to bottom component B1 illustrated and described in connection with bottle sleeve 100 (FIGS. 1 and 6-11).

Placement of a bottle inside an appropriately sized bottle sleeve of the present invention causes the bottle sleeve to become structurally stronger than without the bottle, because (1) the bottle prevents the bottle sleeve from collapsing inward and (2) the bottle urges the bottle stiffener to fully extend between the rib members, resulting in a more rigid rib than can be obtained without a bottle. A bottle sleeve of the present invention is most appropriately sized for a given bottle when the bottle fits snugly in the bottle sleeve, see for example FIG. 13 depicting bottle 340 positioned in bottle sleeve 100 including rib stiffener 342. The term "snugly" as used herein means closely fitting, while still allowing unobstructed placement of the bottle in the bottle sleeve and allowing unobstructed removal of the bottle from the bottle sleeve Examples of suitable sheet materials for bottle sleeves of the present invention include, but are not limited to: paper products such as 60-80 lb Kraft paper, Kraft paper with a thickness of for example 0.0038 inch (4 point Kraft paper) or 0.0052 inch (5 point), one-side coated stock paper with a thickness of for example 0.0019 inch (19 point), and coated paper with a Kraft backing with a thickness of 0.020 inch (20 point). It is noted that pliable sheet materials for bottle sleeves of the present invention can be printed or non-printed. Bottle sleeves can have a printed text, for example identifying the product and/or the retailer of the product in the bottle that is protected by a bottle sleeve of the present invention.

Advantageously, the present invention provides for the ability to pack bottles, especially wine bottles, in a shipping container without the need for corrugated insert separators, because each bottle is separated from an adjacent bottle by two layers of sleeve material, while the ribs provide additional protection. This reduces the waste of the separators and allows for the reduction in the size of a shipping box.

Bottle sleeves of the present invention include a rib extending between the top and bottom edges of the bottle sleeve. The rib substantially reduces the risk of a bottle rolling on a shelf, also it allows for a bottle display on a substantially horizontal surface while keeping the bottle in its intended position, see FIGS. 22 and 23. The rib stiffener provides stiffness and strength to the rib, thereby substantially reducing deformation and/or compression of the rib when the bottle containing bottle sleeve is packaged and shipped, and when the bottle containing bottle sleeve is placed in a substantially horizontal position, as illustrated and described in connection with FIGS. 22 and 23.

Figure 22:
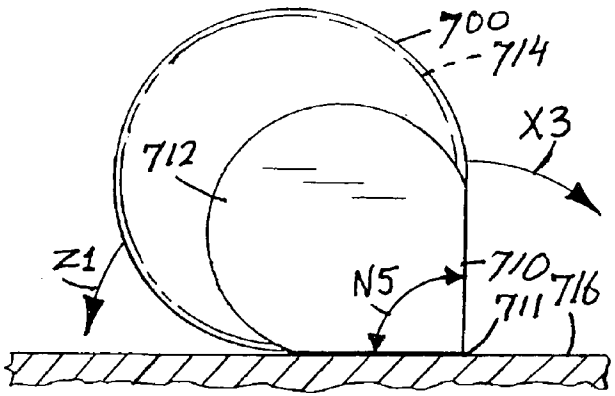
FIG. 22 is a schematic bottom view illustrating another bottle sleeve of the present invention.

With reference to schematic bottom view FIG. 22, a bottle sleeve 700 similar to bottle sleeve 400 (FIG. 14) includes (1) a rib 710 (FIG. 22) having (i) a rib edge 711 and (ii) a rib inside angle N5 substantially equal to 90° and (2) a bottom component 712 similar to bottom component 332 of bottle sleeve 330 depicted in FIG. 11. Returning to FIG. 22, a bottle 714 is positioned inside bottle sleeve 700. When positioned on a substantially horizontal surface 716, rib 710 substantially prevents bottle sleeve 700 and bottle 714 from rolling sideways in direction X3 around edge 711 of rib 710.

Figure 23:
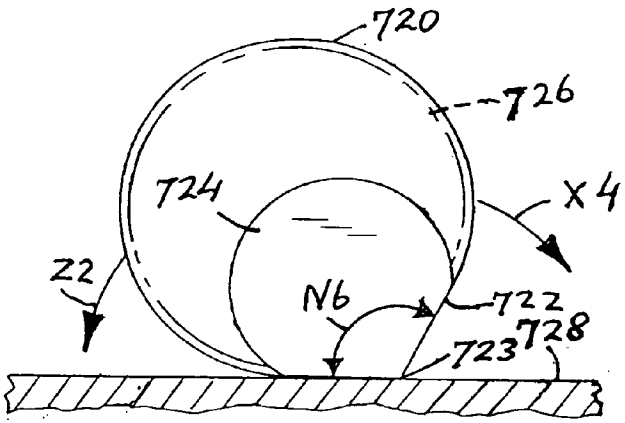
FIG. 23 is a schematic bottom view illustrating yet another bottle sleeve of the present invention.

As depicted in schematic bottom view FIG. 23, a bottle sleeve 720 similar to bottle sleeve 440 (FIG. 15) includes (1) a rib 722 (FIG. 23) having (i) a rib edge 723 and (ii) a rib inside angle N6 substantially equal to 120° and (2) a bottom component 724 similar to bottom component 332 of bottle sleeve 330 depicted in FIG. 11. Returning to FIG. 23, a bottle 726 is positioned inside bottle sleeve 720. When positioned on a substantially horizontal surface 728, rib 722 substantially prevents bottle sleeves 720 and bottle 726 from rolling sideways in direction X4 around edge 723 of rib 722.

It is noted that bottle sleeve ribs of the present invention do not prevent bottle sleeve 700 from rolling in direction Z1 (FIG. 22) and bottle sleeve 720 rolling in direction Z2 (FIG. 23). In other words, protection against rolling is obtained only on the sleeve side of the rib and only if the rib contacts the surface upon which the bottle sleeve is positioned.

Figure 24:
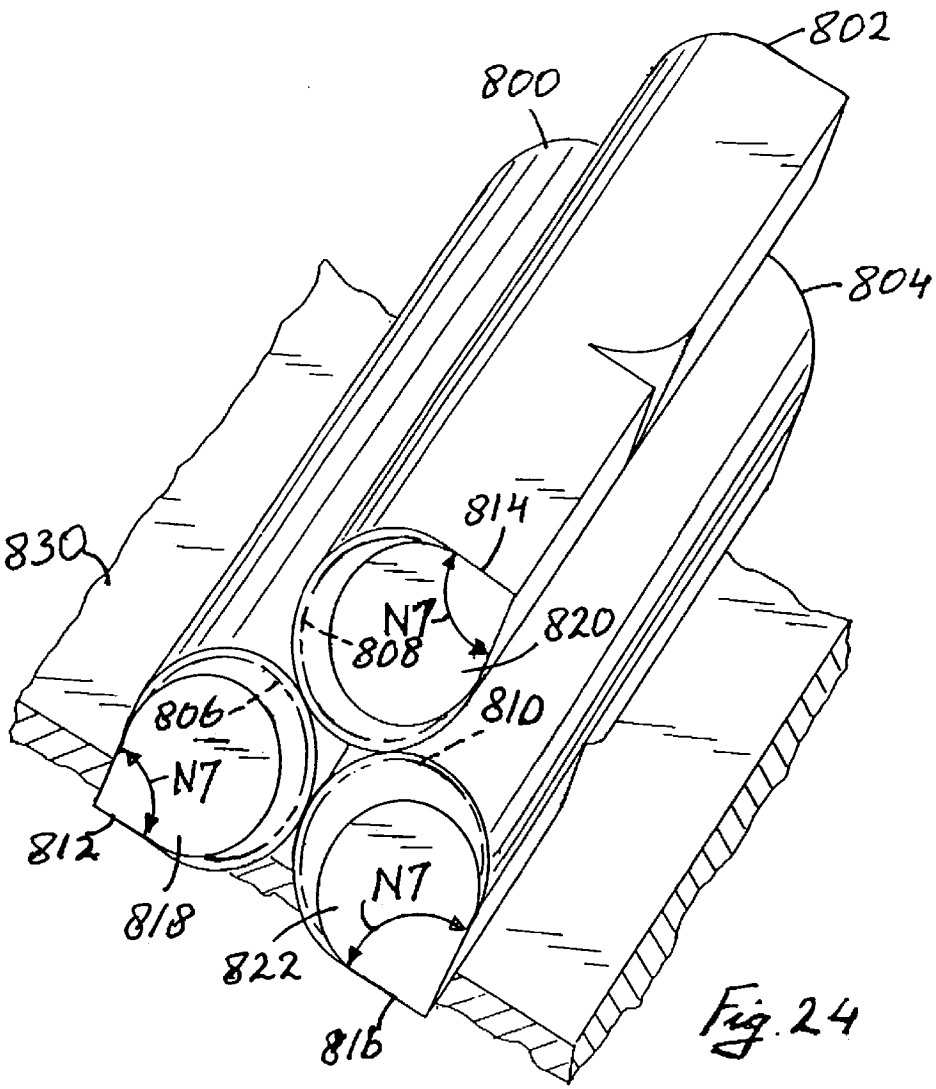
FIG. 24 is a schematic perspective view illustrating a stack of three bottle sleeves of the present invention positioned on a substantially horizontal surface.

Schematic perspective view FIG. 24 shows bottle sleeves 800, 802 and 804 containing bottles 806, 808 and 810 respectively. Bottle sleeves 800, 802 and 804 include ribs (1) 812, 814 and 816 respectively and (2) bottom components 818, 820 and 822 respectively. Each of the ribs depicted in FIG. 24 includes an inside angle N7 that is substantially equal to 90°. Bottle sleeves 800, 802 and 804 are similar to bottle sleeve 700 illustrated in FIG. 22. Bottle sleeves 800 and 804 are positioned next to each other on a substantially horizontal surface 830, such that ribs 812 and 814 (1) contact surface 830 and (2) face away from each other. Bottle sleeve 802 is positioned on bottle sleeves 802 and 804 as illustrated in FIG. 24. Bottle sleeves 800 and 804 are prevented from rolling sideways since ribs 812 and 816 prevent rotation of bottle sleeves 802 and 804 respectively away from each other. The resistance of bottle sleeves 800 and 804 against rolling sideways allows the stacking of bottle sleeve 802 on bottle sleeves 800 and 804.

Rib inside angles of bottle sleeves of the present invention ranging from an angle substantially equal to 90° to an angle substantially equal to 120° are preferred in order to obtain the above enumerated advantages regarding sideway rolling resistance.

A handle or carrying strap, such as carrying strap 614 of bottle sleeve 600, shown in FIG. 21, facilitates removal of the bottle from a container or storage shelf and reduces the risk of a bottle being dropped by a person moving the bottle from one location to another, such as moving a bottle in a retail store.

The pliable properties of bottle sleeves of the present invention allow unused bottle sleeves to be folded substantially flat (not shown), thus facilitating storage and shipping of bottle sleeves prior to their use.

The invention has been described in terms of exemplary embodiments of the invention. One skilled in the art will recognize that it would be possible to construct the elements of the present invention from a variety of means and to modify the placement of components in a variety of ways. While the embodiments of the invention have been described in detail and shown in the accompanying drawings, it will be evident that various further modifications are possible without departing from the scope of the invention as set forth in the following claims.

I claim:

1. A bottle sleeve comprising a rib, wherein the rib comprises:

a) first and second rib members (i) that are joined in a rib edge and (ii) that are positioned substantially parallel to each other; and wherein the rib edge is substantially perpendicular to the top and bottom edges b) a rib interior positioned between the first and second rib members;

c) a rib inside angle positioned inside the rib interior between the first and second rib members;

d) a substantially wedge shaped cross section;

e) at least one rib stiffener, and a top edge;

a bottom edge; and a substantially cylindrical sleeve sidewall; wherein the sleeve sidewall includes: a sidewall section extending between the top and bottom edges; and the sleeve sidewall is continuous with the first and second rib members.

2. The bottle sleeve of claim 1 wherein (1) the first rib member includes a first rib member width, (2) the second rib member includes a second rib member width and (3) the first and second rib member widths are substantially equal.

3. The bottle sleeve of claim 2 wherein the at least one rib stiffener (1) is positioned inside the rib interior, (2) is attached to the first and second rib members and (3) is positioned substantially perpendicular to the rib edge.

4. The bottle sleeve of claim 3, wherein the sidewall section comprises an inside surface including (1) a radius, (2) an angle, (3) a partial circumference and (4) an axis positioned axially with respect to the inside surface and wherein the axis is substantially parallel to (i) the first and second rib members and (ii) the rib edge.

5. The bottle sleeve of claim 4, wherein the at least one rib stiffener comprises a rib stiffener radius that is substantially equal to the radius of the sidewall section.

6. The bottle sleeve of claim 4 wherein (1) the angle of the inside surface of the sidewall section is substantially equal to 270 degree and (2) the rib inside angle is substantially equal to 90.degree.

7. The bottle sleeve of claim 4, wherein (1) the angle of the inside surface of the sidewall section is substantially equal to 300 degree and the rib inside angle is substantially equal to 120.degree.

8. The bottle sleeve of claim 4 wherein the rib inside angle ranges from a first angle that is substantially equal to 90.degree to a second angle that is substantially equal to 120 degree.

9. The bottle sleeve of claim 4 wherein the angle of the inside of the sidewall section ranges from a first angle that is substantially equal to 270 degree. to a second angle that is substantially equal to 300 degree.

10. The bottle sleeve of claim 1, wherein the bottle sleeve comprises a pliable paper product.

11. The bottle sleeve of claim 1, additionally comprising: a) a substantially cylindrical sidewall including (1) a top edge, (2) a bottom edge and (3) an axis; b) a first sidewall joint; and c) a second sidewall joint.

12. The bottle sleeve of claim 11 wherein the rib overlaps the sidewall.

13. The bottle sleeve of claim 12 additionally including a joint forming section that is continuous with the rib.

14. The bottle sleeve of claim 13 wherein (1) the first sidewall joint is formed in the sidewall and (2) the second sidewall joint is formed by the sidewall and the joint forming section of the rib.

15. The bottle sleeve of claim 11, wherein the rib inside angle ranges from a first angle that is substantially equal to 90 degree to a second angle that is substantially equal to 120 degree.

16. A bottle sleeve comprising:

a) a sleeve sidewall section;

b) a rib that is continuous with the sidewall section, wherein the rib includes (1) first and second rib members that are joined in a rib edge, (2) a rib interior positioned between the first and second rib members and (3) at least one rib stiffener inside the rib interior, wherein the at least one rib stiffener (i) is attached to the first and second rib members and (ii) is in a position substantially perpendicular to the rib edge; and c) a single sheet of a pliable material that includes (1) the sleeve sidewall section and (2) the rib f) a substantially cylindrical sleeve sidewall; wherein the sidewall includes (1) the sidewall section extending between the top and bottom edges and (2) the rib

17. The bottle sleeve of claim 16 wherein the pliable material comprises a paper product.

18. A bottle sleeve comprising:

a) a substantially cylindrical sidewall;

b) a rib overlapping the cylindrical sidewall, wherein the rib includes (1) first and second rib members that are joined in a rib edge, (2) a rib interior positioned between the first and second rib members, (3) at least one rib stiffener inside the rib interior, wherein the at least one rib stiffener (i) is attached to the first and second rib members and (ii) is in a position substantially perpendicular to the rib edge;

and c) a single sheet of pliable material that includes (1) the sidewall and (2) the rib.

19. The bottle sleeve of claim 18 wherein the pliable material comprises a paper product.

* * * * *